US005850621A

United States Patent [19]

Cartalos et al.

[11] Patent Number: 5,850,621

[45] Date of Patent: Dec. 15, 1998

[54] METHOD FOR OPTIMIZING THE CHARACTERISTICS OF AN AXIAL FLUID CIRCULATION IN A VARIABLE ANNULAR SPACE AROUND PIPES

[75] Inventors: Ulysse Cartalos, Courbevoie; Mustafa Haciislamoglu, Ribecourte, both of France

[73] Assignee: Institute Francais du Petrole, Rueil-Malmaison, France

[21] Appl. No.: 419,274

[22] Filed: Apr. 10, 1995

[30] Foreign Application Priority Data

Apr. 15, 1994 [FR] France ..... 94 04622

[51] Int. Cl.[6] ..... G06F 19/00

[52] U.S. Cl. ..... 702/9; 702/12

[58] Field of Search ..... 364/510, 558, 364/803, 422; 73/861, 861.01, 152.01, 152.02, 152.03, 152.18, 152.19, 152.21, 152.23, 152.29, 54.07, 54.13, 54.09, 151, 155; 175/48, 50; 702/9, 12

[56] References Cited

U.S. PATENT DOCUMENTS 4,726,219 2/1988 Pearson et al. ..... 73/53

4,821,564 4/1989 Pearson et al. ..... 73/155

OTHER PUBLICATIONS

SPE Publications, 21 Mar., 1993, Oklahoma pp. 469–482, T.D. Reed & A.A. Pilehvari "A New Model for Laminar, Transitional, and Turbulent Flow of Drilling Muds".

*Primary Examiner*—Donald E. McElheny, Jr.
*Attorney, Agent, or Firm*—Antonelli, Terry, Stout & Kraus, LLP

[57] ABSTRACT

The method according to the invention permits adapting for any fluid, a known model representative of the circulation of a fluid in an annular space around a motionless pipe, centered or eccentric uniformly over the total length thereof, to more complex cases which are encountered in practice and notably in drilling. The invention comprises the application, to the pressure loss values obtained with the known model, of a first correction factor accounting for the eccentricity variations which the pipe may undergo notably because of the variations in the axial load applied or of straightness defects of the conduit, and of a second correction factor representative of the effects due to the rotation of the pipe. The method identifies the prominent pressure loss variations which are observed in narrow annular spaces. The method can be applied to narrow hole petroleum drilling (of the slim hole type).

9 Claims, 5 Drawing Sheets

METHOD FOR OPTIMIZING THE CHARACTERISTICS OF AN AXIAL FLUID CIRCULATION IN A VARIABLE ANNULAR SPACE AROUND PIPES

BACKGROUND OF THE INVENTION

1. Field of the Invention

The present invention relates to a method for optimizing the characteristics of a fluid circulation established in an annular space around a tubular element and notably a rotating tubular element such as a long pipe or a drillpipe string, by taking into account in a dynamic manner the deformations undergone by this tubular element and thus the variation of the annular space around it.

The method according to the invention is particularly suited for narrow annuli where the ratio of the diameter of the inner tubular element to the diameter of the outer conduit is greater than 0.5.

The method according to the invention is applied notably within the scope of petroleum drilling operations or in geotechnics, where it allows determination of the speed field of a drilling fluid circulating in the space around a drillpipe string and of the pressure losses resulting from frictions, for complex geometries of this space, due to the motions and deformations of the pipes.

The method is particularly well-suited for optimizing the conditions of circulation of the fluids during drilling operations performed in narrow wells according to the so-called slim hole technique where, on account of the reduced annular dimensions, pressures may be generated which jeopardize the stability of the formation which is crossed.

2. Description of the Prior Art

A number of publications give an account of theoretical or practical studies on the circulation of fluids in wells around a string of motionless or rotating pipes and the variations in the flow parameters due to the eccentricity of a string of pipes and its deformations, and notably in narrow wells.

The following documents may be cited for example: —Vaughn, R. D., 1965, "Axial Laminar Flow of non Newtonian Fluids in Narrow Eccentric Annuli", S.P.E., Vol.5, Dec., —Bourgoyne, A. T. et al, 1986, "Applied Drilling Engineering", in SPE Text Book Series, Vol.2, —Markatos N. C. G. et al, "Flow in an annulus of non-uniform gap"in Trans. IChemE, Vol.56, —Reed, T. D. et al, 1993, "A new model for Laminar, Transitional and Turbulent Flow in Drilling Fluids", in SPE 25456, Proceedings of the Prod. Operations Symposium, Oklahoma City, Okla., —Marken, C. D. et al, 1992, "The influence of drilling conditions on annular pressure losses", article SPE 24598, —Dodge D. W. and Metzner A. B., 1959, "Turbulent Flow of Non-Newtonian Systems", AIChE Journal, Vol.5, p.33.

The resolution method which is generally used for modelling the behaviour of a fluid circulating in an eccentric annulus is to represent the space around the pipe to a juxtaposition of slots. It was previously considered using this model that either the pipe was centered in the conduit, or any eccentricity was uniform all along this pipe. Within the scope of the length of the hypothesis, the slots are considered as being parallel and of constant thickness over the total length thereof.

The circulation of drilling fluids in a slim hole where a drillpipe string rotates is a complex phenomenon which is difficult to model. Among the important factors influencing pressure losses, for a given mud type and rate, are the rotating speed of the drillpipe string and the geometry of the annular space around and along the drillpipe string notably because of the eccentricity thereof in the hole, its motions, its flexions, etc.

In fact, the respective axes of the drilled hole and of the drillpipe string are most often offset with respect to one another on account of the deviations of one and/of the flexions of the other. The eccentricity of the annular space between them depends on this offset which varies along the drillpipe string.

Therefore in many cases, and notably for well drilling, the existing models, based on the assumption that the relative position of the pipe with respect to the conduit is uniform over its total length, do not model well the complexity of the phenomena. Besides, the existing models do not take into account the significant changes which are brought about due to the mud circulation by the coupling between the effects of the rotation of the pipe and its variable eccentricity with respect to the conduit or to the hole.

Existing models therefore do not enable the driller to predict safely the pressure losses and the real speed fields resulting from all these parameters: rotation of the pipe, effective rheological properties of the fluids used in practice, variable non-uniform eccentricity, etc, and thus to optimize the fluid circulation to be established: flow rate, rheology, considering the rotating speed.

SUMMARY OF THE INVENTION

The object of the method according to the invention is to build a representative model of the speed field of a fluid circulating in a conduit around a tubular pipe of variable eccentricity, for laminar as well as turbulent flow, and of the distribution of the annular pressure losses as a function of the flow rates.

The model allows optimization of the characteristics of a fluid circulation which is established in an annular space around a tubular element whose eccentricity is variable, such as a long pipe or a drillpipe string, subjected to deformations, notably when this annular space is relatively narrow.

The method according to the invention comprises modelling the flow of fluid circulation in the annular space by considering the shape thereof to be variable all along the tubular element and by taking into account the real rheological properties of the fluid (viscosity variation with the shear rate for example), so as to determine the value of the speed field and the value of the pressure at any point along this annular space.

The method can also comprise the application, to these values obtained for a tubular element of variable eccentricity, of a dimensionless correction factor dependent on the Reynolds number (Re) and on the Taylor's number (Ta) of the fluid used, so as to take account of the pressure loss variations in the annulus generated by the rotating speed of the tubular element.

When the respective ratios of the inertial and viscous effects, in the axial direction and the azimuthal direction respectively, are greater than a predetermined value, the dimensionless correction factor to be applied can be determined through the relation:

$$Rp=ARe^{c}Ta^{d}, \text{ where}$$

A, c and d are parameters whose values can be selected within defined ranges.

According to an embodiment of the method, which can be used when the skewness of the tubular element is relatively low, the possible dynamic changes in the shape of the tubular element are taken into account by applying another correction factor, substantially constant and independent of the shape of the tubular element, ranging for example between the following interval:

$$0.1<R<10.$$

The method according to the invention takes into account the two essential factors which govern the evolution of the pressures in narrow annuli: the variable eccentricity and the rotation of the tubular element. It therefore allows the annulus pressure to be related in a reliable manner to the operating parameters: geometry, flow rate, rotating speed, and to the rheology of the circulating fluid.

The distribution of the pressure losses, which is determined by applying the method according to the invention, as it is defined above, in complex cases where any fluid circulates in a narrow annulus around a rotating pipe subjected to deformations, particularly when the annular space around the pipe is narrow, is in keeping with the practical results which have been measured.

Within the scope of drilling operations notably, application of the method thus allows defining the optimum fluid rheology to maintain a high flow rate enabling good cuttings removal to be obtained without the annulus pressures going beyond a safety range and damaging the hole. The method thus allows defining rules concerning the rheology and therefore the composition of the fluids, and notably fluids without solid particles used in slim holes.

BRIEF DESCRIPTION OF THE DRAWINGS

Other features and advantages of the method according to the invention will be clear from reading the description hereafter, with reference to the accompanying drawings in which.

DESCRIPTION OF THE PREFERRED EMBODIMENTS

Figure 1:
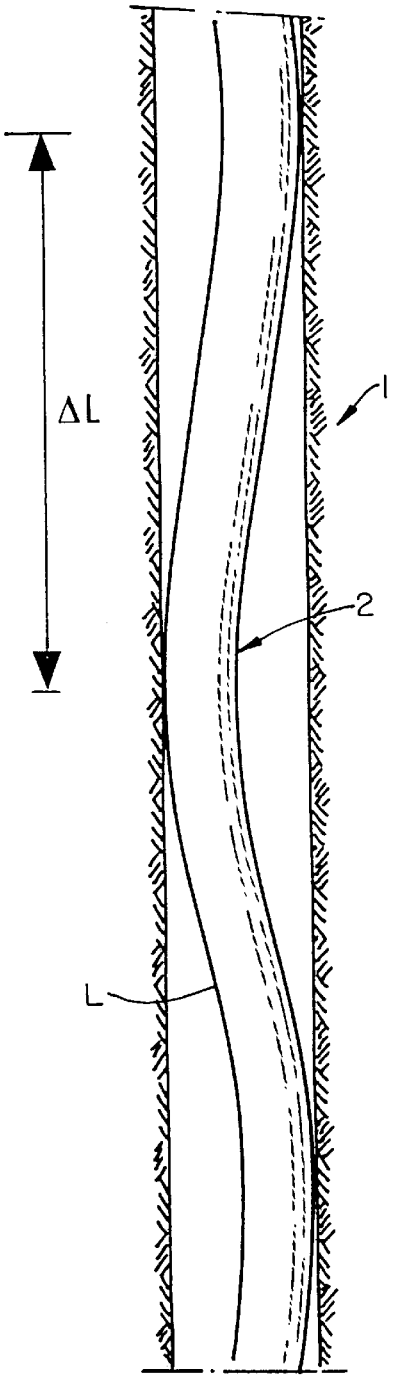
FIGS. 1 and 2 diagrammatically show an elongated tubular element subjected to deformations of respectively sinusoidal and linear variation.
Figure 2:
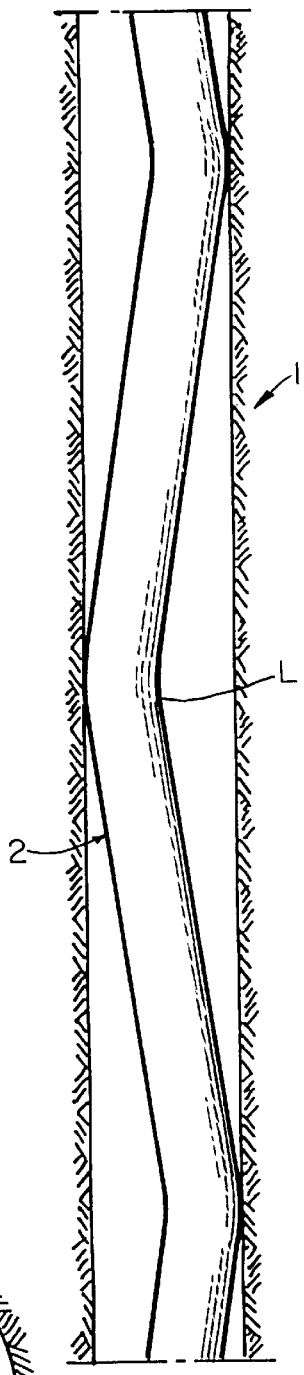
Figure 3:
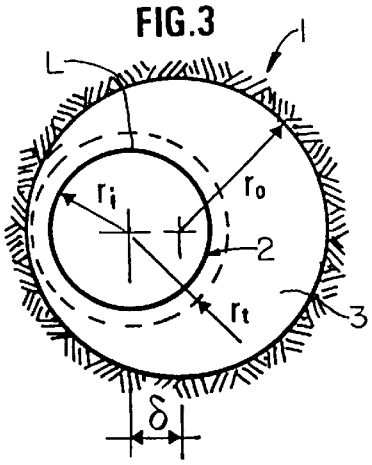
FIG. 3 diagrammatically shows in cross-section an eccentric tube in a conduit such as a well.

In a well 1, the shape of the drillpipe string 2 driving the bit varies generally from one site to the other (FIGS. 1 to 3). It depends on the deviation of the drilled hole, on the tension or the compression exerted on the pipe, etc. The real configuration of a drillpipe string is defined by three geometric parameters:

the eccentricity, which is a dimensionless number whose value is 0 when the pipe and the conduit are concentric and 1 when the pipe touches the inner wall of the conduit, as defined by the relation:

$$e = \frac{\delta}{R_0 - R_i} \tag{1}$$

$R_0$ and $R_i$ are respectively the radii of the conduit and of the pipe (FIG. 1), and is the distance between their respective axes;

the maximum eccentricity, which is less than 1 if the pipe is provided with centralizers (of radius $R_t$) which prevent it from touching the wall of the conduit;

$$e_{max} = \frac{R_0 - R_t}{R_0 - R_i} \tag{2}$$

the skewness S, which is the ratio of the average diameter of the annular space $d_{avg}=2r_{avg}$ to the the interval between two successive inflections of the pipe L, $$S = \frac{d_{avg}}{\Delta L}\ . \tag{3}$$

Figure 4:
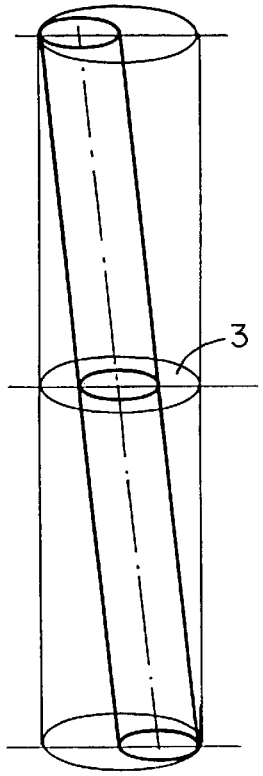
FIGS. 4 and 5 diagrammatically show a skew annulus respectively in a closed and in a spread position.
Figure 5:
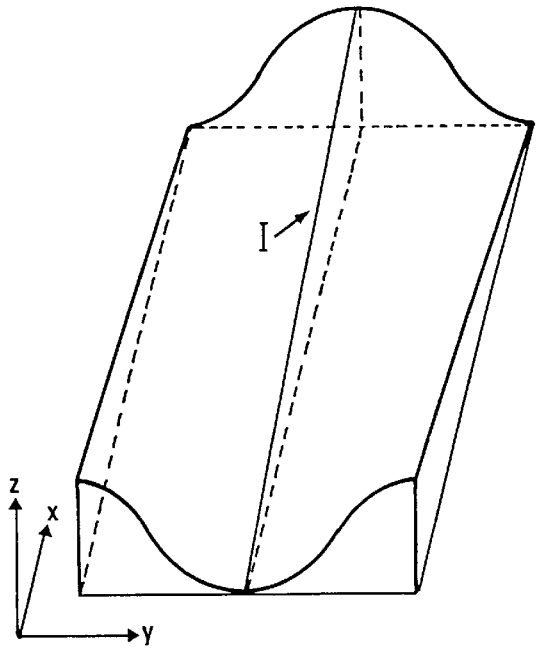
Figure 9:
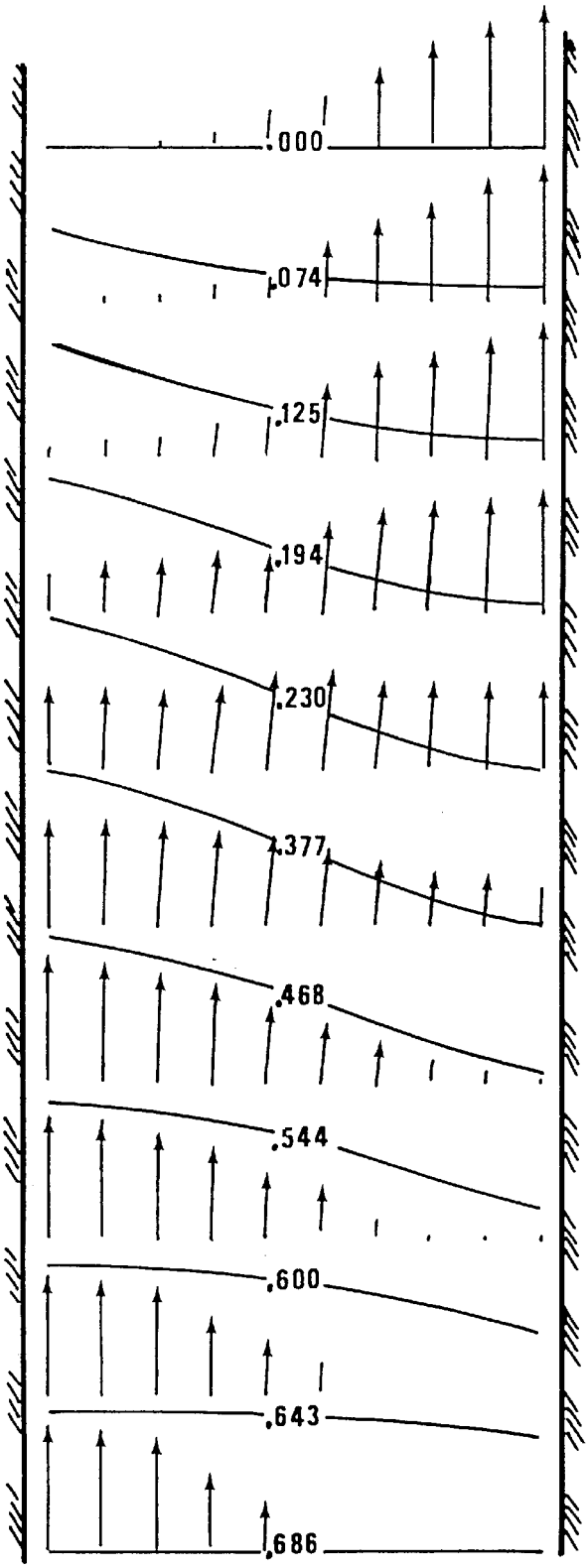
FIG. 9 shows the distribution of speeds V and the pressure isovalues in an annulus whose configuration varies in a sinusoidal way along its axis.

For the calculations, according to a known model, the annular space 3 is likened to a series of juxtaposed slots of variable thickness according to the real eccentricity. The annular space 3 around the pipe is spread out (FIGS. 4, 5) and the fluid is assumed to flow between a certain number of plates of variable distance in the axial direction (FIG. 9).

It can be shown that, for $0 \leqq x \leqq L$ and $0 \leqq y \leqq 2r_{avg}$, the expressions of the equations given in Cartesian co-ordinates the thickness of the slots for a skew annulus of sinusoidal (FIG. 1) or rectilinear variation (FIG. 2) are as follows:

$$z(x,y) = (R_0 - R_i)\left(1 + e_{max}\left(1 - \frac{2x}{\Delta L}\right)\cos\left(\frac{y}{r_{avg}}\right)\right) \tag{4}$$

$$z(x,y) = (R_0 - R_i)\left(1 + e_{max}\cos\left(\frac{\pi x}{\Delta L}\right)\cos\left(\frac{y}{r_{avg}}\right)\right) \tag{5}$$

with $e_{max}$ defined by (2) and $r_{avg}=0.5d_{avg}$.

The following dimensionless motion equation is used to model the flow of the fluid in a relatively thin annular space whose eccentricity is variable:

$$\frac{\partial}{\partial x_D}\left(\frac{z_D^3\,\partial P_D}{fRe\eta_D\partial x_D}\right) + \left(\frac{2}{\pi S}\right)^2\frac{\partial}{\partial y_D}\left(\frac{z_D^3\,\partial P_D}{fRe\eta_D\partial y_D}\right) = 0 \tag{6}$$

with $x_D=x/_{\Delta}L$, $y_D=y/\pi r_{avg}$, $z_D=z/(D_o-D_i)(D_i 2R_i$ and $D_o=2R_o)$ which relates the pressure P, the axial speed u, the azimuthal speed v, the viscosity , the co-ordinates $X_0$ (axial) and $Y_0$ (azimuthal), $Z_0$ the ratio S defined by (3), the friction coefficient f and the Reynolds number Re.

Two relations connecting the pressure and the averaged speed components in a radial direction are also used:

$$u_D = 24\frac{z_D^2\,\partial P_D}{f\,Re\,\eta_D\,\partial x_D} \tag{7}$$

$$v_D = 24\frac{z_D^2\,\partial P_D}{f\,Re\,\eta_D\,\partial y_D}\ . \tag{8}$$

The value of the dimensionless Viscosity D is 1 for Newtonian fluids. For non-Newtonian fluids, the velocity of flow and the transverse length scale are taken into account for calculating this dimensionless viscosity. $P_D=P/P_0$ where $P_0$, which represents the pressure losses of the fluid circulating in a concentric annulus similarly reduced to a slot, is calculated by the relations established by Reed et al in the publication cited above.

Numerical Model

The previous relations are applied to a numerical model of the finite difference type such as that defined by Markatos et al in the above-mentioned publication, where the annular space is divided into grids, each one representing a slot such as they are defined above, whose thickness is determined by solving Equations (4) or (5).

The Markatos model, which was applied to Newtonian fluids, is improved as described hereafter to take into account the whole of the rheological laws to which drilling fluids are subject.

For a given P, at the abscissa x=0, the model initially considers a linear variation profile of the pressure and an average speed field based on a given flow rate for each slot. The Reynolds number Re, the friction coefficient (f) and the viscosity are calculated.

For a Newtonian fluid of laminar flow for example, the product fRe is equal to 24 and the viscosity is independent of the shearing. In this case, Equations (6) to (8) are simplified.

The modelling method according to the invention allows the scope of the previous model to be extended to non-laminar flow regimes of any fluids whose shear thinning index n' is generally less than 1, which correspond better to the circulations to be modelled in practice.

Figure 8:
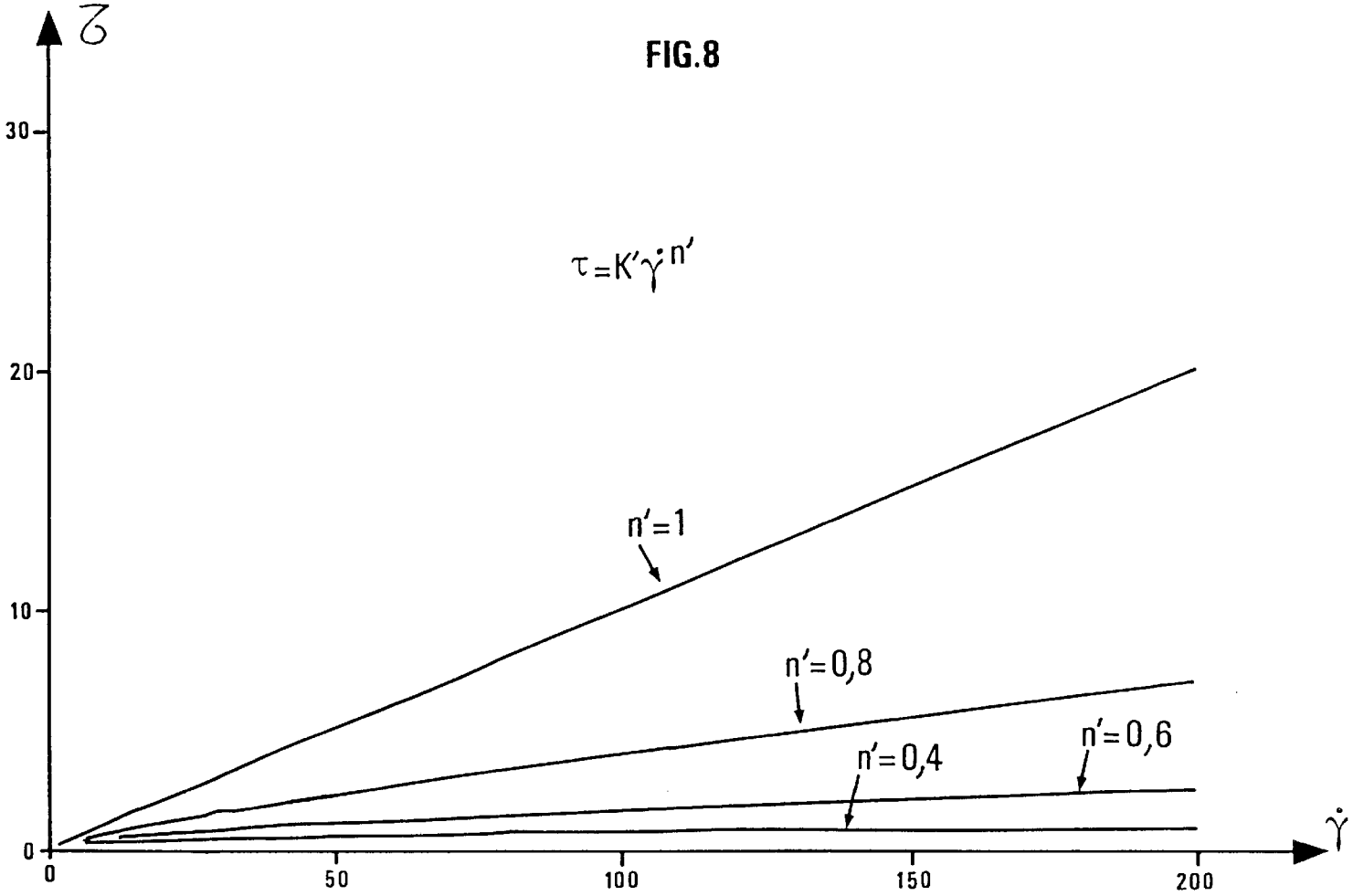
FIG. 8 shows how the shear stress varies with the shear rate, in the case of Newtonian fluids and of non-Newtonian fluids.

For a non-Newtonian fluid, this relation has to be modified. The product fRe of the correction factor f by the Reynolds number Re must first be integrated into Equations (6) to (8), for any fluids. The viscosity of the fluids generally varies with the shear rate (FIG. 8). They comply with the rheological law:

$$\tau=K'\dot{\gamma}^{n'} \tag{9}$$

where $\tau$ is the shear stress and K' and n' are the parameters defined in the above-cited publication by Dodge D. W. et al.

In order to take into account this type of fluid, the definition of the Reynolds number Re is modified and the method described by Reed, T. D. et al in the above-cited publication is used, between this modified number Re and the friction coefficient f, for the resolution of the model.

The so-called GNM method described by Reed et al in the above-mentioned publication is used to assess the diffusion term $z_D^3/fRe\eta D$ in Equation (6). This diffusion term being known for each grid, the discrete form of Equation (6) is solved to obtain a new pressure field. A new speed field is calculated from the same Equations (7) to (8). The calculations are repeated until a convergence of the calculated speed fields is obtained. An example of a speed field obtained with a sinusoidal eccentricity is shown in FIG. 9.

In all the cases where the flow becomes turbulent in the wider parts of the annular space while remaining laminar in the narrow parts, because of a fast variation of the diffusion term from one grid to the other, a relaxation method known in the art is used. It allows stability to be increased, but it decreases the rate of convergence.

When convergence is obtained, the numerical integration of the axial speed field gives the flow rate.

Simple modifications of Equations (4) and (5) allow the model to be adapted to cases of zero or uniform eccentricity of the pipe.

Eccentricity Corrections

Estimation of the speed field and of the distribution of the pressure losses in a narrow annulus is very complex on account of the possible diversity of the skewness and of the eccentricity of the pipe under real working conditions.

However, the method according to the invention allows the speed field and the pressure loss distributions around a rotating pipe of great length to be modelled.

In the general case of a pipe whose skewness coefficient (1/S) is low, the distribution of the pressure losses is determined by integrating into the model defined by relations 6 to 8 the analytic expressions of the thickness variation of the slots corresponding to the real shape of the pipe, and for example Equations (4, 5) if the deformation of the pipe is of the sinusoidal or linear type. This leads to complex calculations.

The method according to the invention provides a much more simple solution in the case where the skewness of the pipe is low (higher 1/S factor).

A correction factor R is defined as the ratio, for the same flow rate, of the pressure losses per unit of length (P/L)e, generated by an eccentric pipe, to the corresponding pressure losses (P/L)c generated by the same centered pipe.

Figure 6:
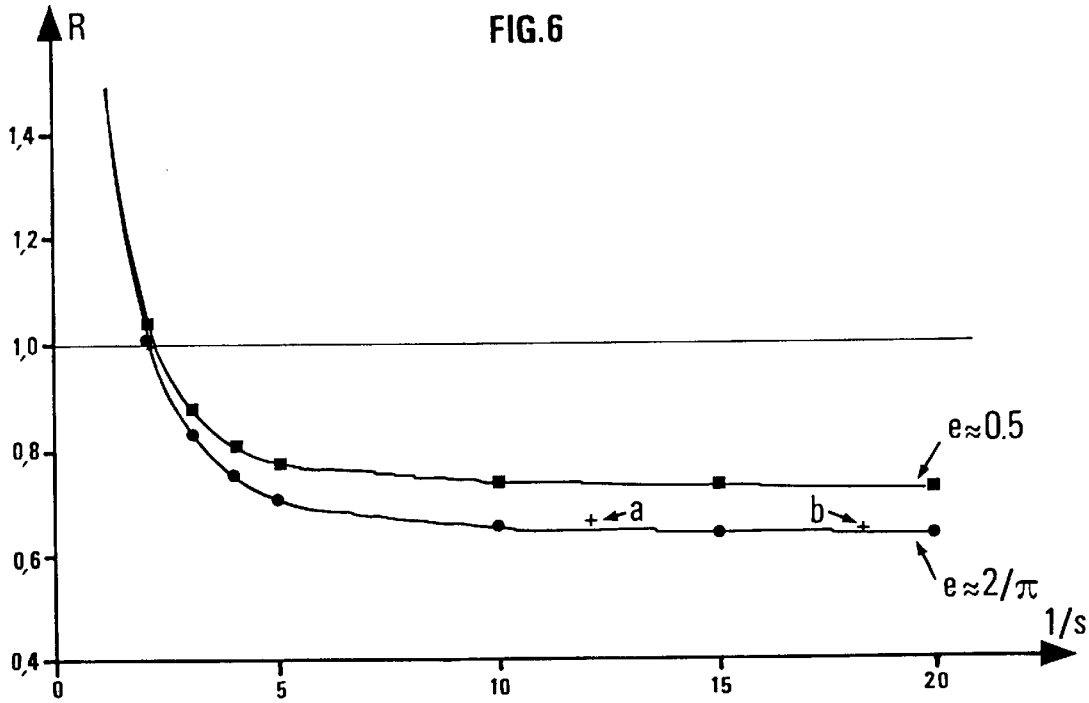
FIG. 6 diagrammatically shows the variation, as a function of the skewness of a tubular element, of a correction factor to be applied to the pressure losses obtained by assuming a zero or invariable eccentricity, predicted by the method of the invention and experimentally corroborated.

The curves of FIG. 6, determined by modelling in accordance with the method, show that the correction factor R varies in an asymptotic manner and remains practically invariable whatever the real shape (broken line or sinusoidal shape) of the pipe, when the skewness coefficient 1/S reaches rather high values (1/S>10), which corresponds to a low deformation of the pipe.

Fluid circulation laboratory tests have been carried out with an installation comprising a 24-mm inside diameter conduit and a 18-mm outside diameter inner pipe sinusoidally bent. In FIG. 6, point a of co-ordinates 1/S=12, R=0.66 and point b of co-ordinates 1/S=18, R=0.64 correspond respectively to values obtained during these tests. Comparing the model predictions and the experimental results shows that they agree in an excellent way.

Under normal conditions of use, the deformation of a pipe in a narrow conduit or slim hole, notably of a drillpipe string in an oil well, is generally not marked. This is the most common method of operation in practice. The pressure losses resulting from an eccentricity of the pipe (P/L)e can thus be calculated simply, substantially regardless of the skewness coefficient 1/S in the case of annuli of great length.

Figure 7:
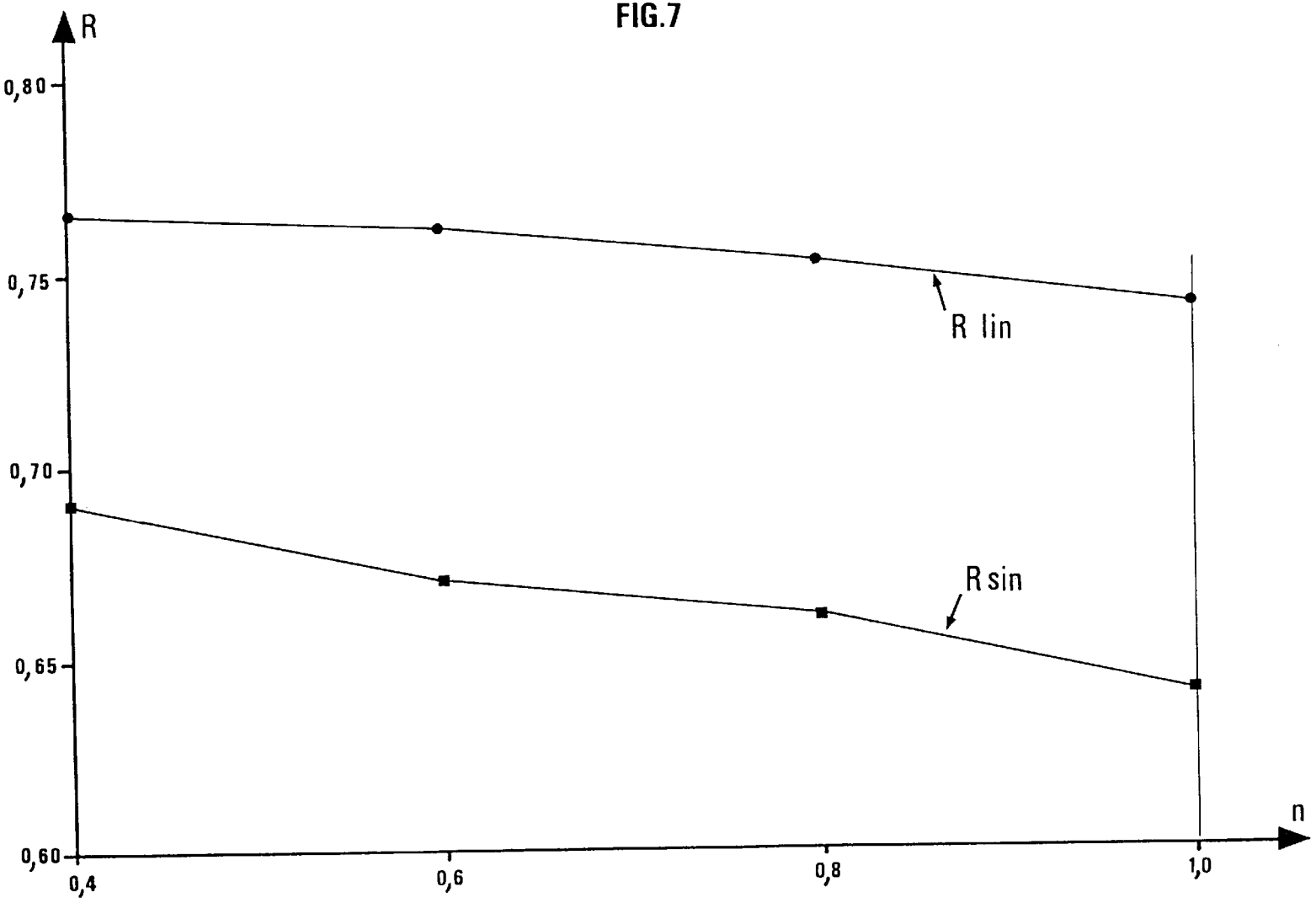
FIG. 7 diagrammatically shows the variation, as a function of the shear thinning index, of the same correction factor.

The calculation may generalize in the case of non-Newtonian fluids, whatever their shear thinning degree. The variation of the correction factor R which has to be introduced when the pipe is eccentric but slightly skewed (high 1/S value) as a function of the shear thinning index n is shown in FIG. 7 for a skewness of the linear or sinusoidal type.

Introducing this correction factor R thus permits easily to obtaining of, for low skewnesses, the results of an eccentric configuration from the results obtained in the case of a centered pipe, for any rheological law of the type given by relation (9).

Rotation Corrections

The values obtained by modelling must thereafter be modified to take into account the effects generated by the rotation of the pipe.

Tests concerned with the flow of a shear-thinning fluid around a pipe centered in a conduit have shown that the evolution of the pressure loss as a function of the rotating speed W depends on the flow regime generated by the coupling of the axial motion and of the tangential motion.

It is known that a tangential flow between two coaxial cylinders characterized by the magnitude of the Taylor's number defined by $$Ta = \frac{\rho W D_i (D_0 - D_i)}{4\eta} \left( \frac{D_0 - D_i}{D_i} \right)^{1/2} \tag{10}$$

where W is the rotating speed and n is the viscosity.

In the absence of any axial motion, the tangential flow is governed by the Taylor's number Ta. When Ta<41.3, the flow is laminar. For Taylor's numbers ranging between 41.3 and about 400, it is observed that stable vortexes referred to as Taylor's vortexes are superposed on the circular current lines. The flow becomes turbulent for Ta values>400.

It is also well-known that, when superposed on a tangential flow, an axial flow modifies the values of Ta corresponding to the limits of the transition zone. Similarly, a tangential flow superposed on an axial flow can affect the values of Re corresponding to a laminar-turbulent transition in the axial direction.

In order to bring out the overall trends of the effects of the rotation of the pipe and the value of the correction factors to be brought to the previous results, so as to take into account the flow type, it is useful to put the different parameters into a dimensionless form.

The Reynolds number defined by Dodge et al for a non-Newtonian fluid in the above-mentioned publication is thus used.

The Taylor's number characterizing the ratio of the inertial effects to the viscous effects in the azimuthal direction is given by relation (10) providing that its definition is extended so as to include the shear thinning effects. To that effect, the Newtonian viscosity has to be replaced in this relation by the viscosity of a power-law fluid, calculated at the value of the shear rate on the inner wall (against the pipe) corresponding to the rotating speed W.

The ratio Rp of the annulus pressure for a given rotating speed W to the annulus pressure for a zero rotation at the same flow rate is also defined by the relation:

$$R_p = \frac{\Delta P_W}{\Delta P_{W=0}} \ . \tag{11}$$

Another dimensionless parameter is constructed from the Taylor's and Reynolds numbers:

$$R_W = \frac{W R_i}{U_m} \tag{12}$$

where $U_m$ is the velocity of flow. $R_w$ is a measurement of the ratio of the shear rates respectively in the azimuthal and in the axial direction.

The results obtained vary as a function of the values taken by the Reynolds and the Taylor's numbers:

1) Low Reynolds numbers (Re<200):

The ratio Rp decreases when the parameter Rw increases and it becomes significant when Rw becomes greater than 2. The pressure drop observed is related to the decrease in the fluid viscosity which is related to the superposition of the azimuthal shear on the axial shear. The pressure loss decrease which is observed for low values of the Reynolds number is the result of the viscosity loss brought by the tangential motion.

2) Low Taylor's numbers (Ta<200):

The pressure ratio Rp asymptotically tends to a limit $R_{pl}$ greater than 1 for values of the Taylor's number Ta<200.

3) Taylor's and Reynolds numbers greater than 200

For this variation range, an empirical relation has been established as follows:

$$Rp = A Re^{c} Ta^{d} \tag{13}$$

where coefficients A, c, d range between the following values:

$$0<A<10$$

$$0<c<2$$

$$0<d<2$$

with typical values as follows: A=0.29, c=0.17 and d=0.067.

Application to the results of this second correction factor dependent on the rotating speed and on the type of flow thus allows the pressure losses along the pipe to be obtained.

We claim:

1. A method for preventing overpressure of a drilling fluid circulated in a well of known diameter during drilling operations by drilling equipment including an elongated drillstring of known diameter with the overpressure resulting from variations of eccentricity of the drillstring along a length thereof comprising:

solving a set of modeling equations using measured rheological properties of drilling fluids including variations of fluid viscosity of the fluids with shear rate to determine a distribution of pressure and speed along the drillstring; and using the determined distribution of pressure and speed along the drillstring to select a drilling fluid with specified rheological characteristics and a flowrate in the well preventing an overpressure along the drillstring.

2. A method as claimed in claim 1 further comprising:

determining a dimensionless correction factor (R) by comparing a distribution of speeds in the drilling fluid along an annular space between the well and the elongated drillstring and pressure losses resulting from the eccentricity, and corresponding speeds and pressure losses of the drillstring when centered in the well.

3. A method according to claim 2 further comprising:

applying a dimenionless correction factor (R) which is substantially constant and independent of a shape of the drillstring when subjected to deformations.

4. A method as claimed in claim 2 wherein the correction factor is selected within the range:

$$0.1<R<10.$$

5. A method as claimed in claim 3 wherein the correction factor is selected within the range:

$$0.1<R<10.$$

6. A method according to claim 1 further comprising:

applying to the distribution of pressure a second dimensionless factor (Rp) depending on a Reynold's number and a Taylor's number of the fluids which accounts for effects of a rotation of the drillstring; and selecting a drilling fluid having rheological characteristics and a flowrate to maintain the pressure of the distribution of pressure under a determined overpressure.

7. A method according to claim further comprising:

applying to the distribution of pressure a second dimensionless factor (Rp) depending on a Reynold's number and a Taylor's number of the fluids which accounts for effects of a rotation of the drillstring; and selecting a drilling fluid having rheological characteristics and a flowrate to maintain the pressure of the distribution of pressure under a determined overpressure.

8. A method according to claim 6, wherein the dimensionless correction factor (Rp) is determined by applying the following relation:

$$Rp=AR^{c}eT^{d}a, \text{ where}$$

$$0<A<10$$

$$0<c<2 \text{ and}$$

$$0<d<2,$$

when respective ratios of inertial and viscous effects in an axial direction of the drillstring and an azimuthal direction respectively are greater than a predetermined value.

9. A method according to claim 7, wherein the dimensionless correction factor (Rp) is determined by applying the following relation:

$$Rp=AR^{c}eT^{d}a, \text{ where}$$

$$0<A<10$$

$$0<c<2 \text{ and}$$

$$0<d<2,$$

when respective ratios of inertial and viscous effects in an axial direction of the drillstring and an azimuthal direction respectively are greater than a predetermined value.

* * * * *